US011354942B2

(12) United States Patent
Kawano et al.

(10) Patent No.: US 11,354,942 B2
(45) Date of Patent: Jun. 7, 2022

(54) INPUT DATA CREATION DEVICE AND INPUT DATA CREATION METHOD

(71) Applicant: TOYOTA JIDOSHA KABUSHIKI KAISHA, Toyota (JP)

(72) Inventors: Kentaro Kawano, Toyota (JP); Atsushi Watanabe, Nisshin (JP); Youichi Suzuki, Toyota (JP); Takashi Agari, Toyota (JP); Ryosuke Mori, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 262 days.

(21) Appl. No.: 16/738,213

(22) Filed: Jan. 9, 2020

(65) Prior Publication Data

US 2020/0242854 A1 Jul. 30, 2020

(30) Foreign Application Priority Data

Jan. 24, 2019 (JP) ..... JP2019-010406

(51) Int. Cl.
*G07C 5/00* (2006.01)
*G07C 5/08* (2006.01)

(52) U.S. Cl.
CPC ..... *G07C 5/008* (2013.01); *G07C 5/085* (2013.01); *G07C 5/0808* (2013.01)

(58) Field of Classification Search
CPC ..... G07C 5/008; G07C 5/0808; G07C 5/085; G07C 5/0825; G06F 16/40; G01C 25/00
See application file for complete search history.

(56) References Cited

U.S. PATENT DOCUMENTS

2020/0209002 A1* 7/2020 Hou ..... G01C 21/3804

FOREIGN PATENT DOCUMENTS

JP 2017-146699 A 8/2017

* cited by examiner

*Primary Examiner* — Michael V Kerrigan
(74) *Attorney, Agent, or Firm* — Oblon, McClelland, Maier & Neustadt, L.L.P.

(57) ABSTRACT

In an input data creation device, a reception unit is configured to acquire diagnostic information of a vehicle and traffic information output from an external device. A data generation unit is configured to extract vehicle status data including a plurality of data elements indicating a vehicle status from the diagnostic information to generate input data for operating a multimedia device for a vehicle. A command unit is configured to give an instruction such that the multimedia device operates based on the input data. The data generation unit is configured to set a timing at which traffic information is generated on a time axis of the input data, and change values of the data elements.

4 Claims, 4 Drawing Sheets

INPUT DATA CREATION DEVICE AND INPUT DATA CREATION METHOD

INCORPORATION BY REFERENCE

The disclosure of Japanese Patent Application No. 2019-010406 filed on Jan. 24, 2019 including the specification, drawings and abstract is incorporated herein by reference in its entirety.

BACKGROUND

1. Technical Field

The present disclosure relates to an input data creation device and an input data creation method that create input data for testing a multimedia device to be mounted in a vehicle.

2. Description of Related Art

Japanese Unexamined Patent Application Publication No. 2017-146699 (JP 2017-146699 A) discloses an operation simulator system that performs an operation test of a navigation device provided in a virtual vehicle. In the operation simulator system, the navigation device is made to acquire pseudo traffic information and pseudo vehicle control information predicted to be acquired in a case where traveling along a test traveling route is assumed in a traveling aspect and an operation aspect according to a traveling scenario, and as a result, information indicating a defect is output in a case where the defect occurs in the operation of the navigation device.

SUMMARY

In the technique disclosed in JP 2017-146699 A, although the operation of the navigation device during traveling along the virtual test traveling route is simulated using the pseudo vehicle control information, a lot of effort is needed to create the pseudo vehicle control information with high accuracy.

The disclosure has been accomplished in consideration of such a situation, and provides a technique that easily creates input data for operating a multimedia device for a vehicle.

A first aspect of the disclosure relates to an input data creation device. The input data creation device includes a reception unit and a data generation unit. The reception unit is configured to acquire diagnostic information of a vehicle and traffic information output from an external device. The data generation unit is configured to extract a plurality of data elements indicating a vehicle status during vehicle traveling from the diagnostic information to generate input data for operating a multimedia device for a vehicle based on the extracted data elements. The data generation unit is configured to set a timing at which the traffic information is generated on a time axis of the input data, and change values of the data elements included in the input data.

A second aspect of the disclosure relates to an input data creation method. The method includes a step of acquiring diagnostic information of a vehicle and traffic information output from an external device, and a step of extracting a plurality of data elements indicating a vehicle status during vehicle traveling from the diagnostic information to generate input data for operating a multimedia device for a vehicle based on the extracted data elements. In the generating step, a timing at which the traffic information is generated on a time axis of the input data is set, and values of data elements included in the input data are changed.

According to the aspects of the disclosure, it is possible to provide a technique that easily creates input data for operating a multimedia device for a vehicle.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

An input data creation device of an embodiment creates input data for testing an operation of a multimedia device. Input data is time-series data that makes the multimedia device simulate a vehicle status during vehicle traveling, and includes a plurality of data elements, such as a data element indicating a vehicle position and a data element indicating a vehicle speed.

The multimedia device is equipment capable of executing a plurality of media functions, and outputs information from an output unit, such as an in-vehicle display, a speaker, or an alarm, to occupants according to execution of each media function. The multimedia device combines the media functions, and the media functions are functions of outputting at least one character data, image data, and sound data, and include, for example, an audio function, a navigation function, a video reproduction function, a notification function of traffic information, and the like.

Input data for a simulation that is provided to operate the multimedia device includes vehicle status data, such as GPS information, vehicle speed information, and acceleration information, traffic information output from an external device, and the like. Input data creation devices 14 of the embodiment creates input data based on vehicle status data acquired in a time series in a vehicle that actually travels.

Figure 1:
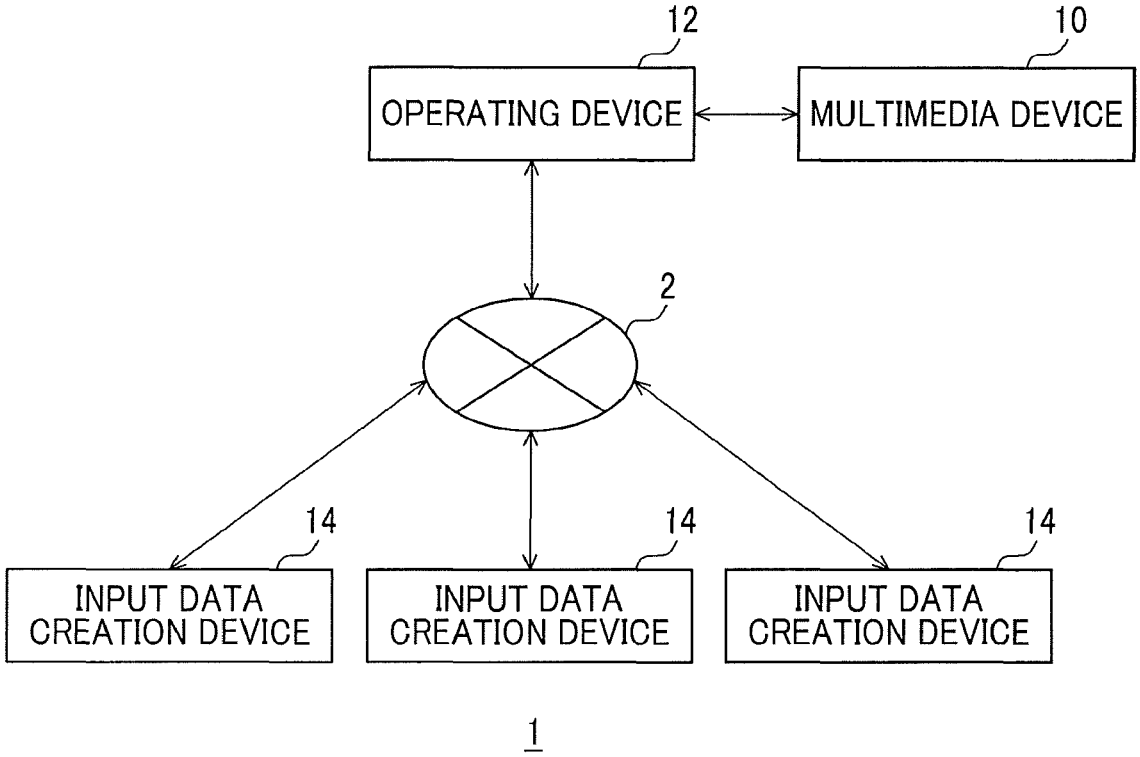
FIG. 1 is a diagram showing the schematic configuration of a vehicle traveling simulation system.

FIG. 1 is a diagram showing the schematic configuration of a vehicle traveling simulation system 1. The vehicle traveling simulation system 1 includes a multimedia device 10 for a vehicle, an operating device 12 that operates the multimedia device 10, and a plurality of input data creation devices 14 that are connectable to the operating device 12 through a network. The multimedia device 10 and the operating device 12 are arranged in a laboratory. The input data creation devices 14 may be arranged at remote places apart from the laboratory.

The vehicle traveling simulation system 1 simulates the operation of the multimedia device 10 during vehicle traveling. The vehicle traveling simulation system 1 receives input data from the input data creation devices 14 at places apart from the multimedia device 10 and executes a simulation.

The multimedia device 10 is a prototype that is mounted in a vehicle in the future, and has at least a function to be a test target among the media functions to be mounted in the vehicle. The multimedia device 10 may be in a state of being mounted in the vehicle or may be in a state before being mounted in the vehicle.

The multimedia device 10 acquires a plurality of kinds of data elements for a vehicle, and outputs an output result based on the data elements from the output unit. The data elements for a vehicle include data acquired from in-vehicle equipment, such as audio data, operation information of occupants, camera images, and detection information of in-vehicle sensors, and data acquired from the outside, such as radio data, global positioning system (GPS) information, electronic toll collection system (ETC) information, and beacon information.

Each of the input data creation devices 14 creates input data for a simulation, inputs the input data from the operating device 12 to the multimedia device 10 to make the multimedia device 10 simulate the vehicle status during vehicle traveling, and evaluates whether or not a desired output is obtained. That is, the input data creation device 14 has a function of creating input data and a function of testing the multimedia device 10 based on the input data. The input data creation device 14 is connected to the operating device 12 to perform communication through a network, such as the Internet.

Input data for a simulation is time-series data that operates the media functions in the multimedia device 10, and makes the multimedia device 10 simulate the state during vehicle traveling. Input data includes various kinds of data elements including vehicle status data, such as positional information and traveling state information in a case where the vehicle actually travels, traffic information based on beacons or the ETC, infrastructure information based on radios or wireless LANs, and the like.

The operating device 12 is connected to the multimedia device 10, receives data indicating the vehicle status during vehicle traveling as input according to instructions of the input data creation devices 14, and operates the multimedia device 10 under a virtual traveling situation. The operating device 12 converts, for example, information of the in-vehicle sensors received from the input data creation devices 14 to signals to be output from actual in-vehicle sensors and inputs the signals to the multimedia device 10.

Figure 2:
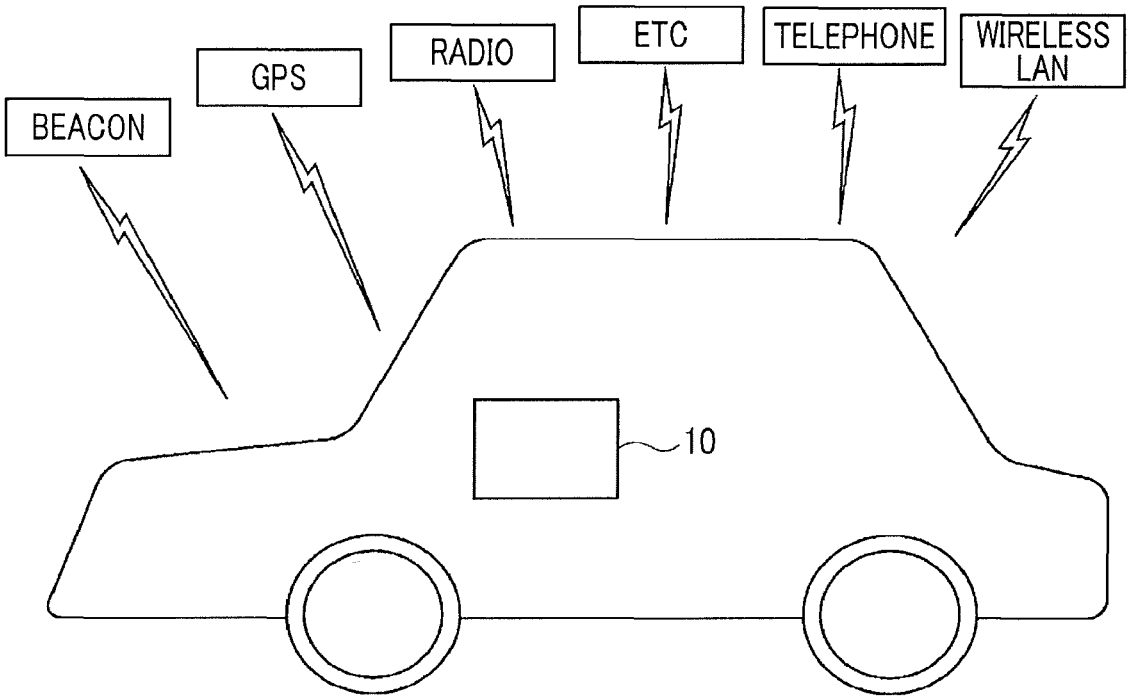
FIG. 2 is a diagram illustrating data elements for a vehicle input to the multimedia device from the outside during vehicle traveling.

FIG. 2 is a diagram illustrating the data elements for a vehicle that are input to the multimedia device 10 from the outside during vehicle traveling. The data elements for a vehicle, such as beacon information output from beacons provided on roads, GPS information acquired from GPS satellites, and radio data and telephone data acquired from base stations, are input to the multimedia device 10 from the outside during vehicle traveling. The beacon information and the ETC information are the traffic information output from the external device provided on the road.

A test of the multimedia device 10 is executed after confirmation is made that various media functions of the multimedia device 10 operate normally alone. Since the multimedia device 10 uses a plurality of media functions simultaneously, such as a case where interrupt notification of the traffic information or telephone communication is executed during execution of a navigation function, there is a need to test whether or not the media functions operate normally in a case where the media functions are used simultaneously.

Among the data elements for a vehicle, for example, radio broadcast may include analog broadcast, digital broadcast, satellite broadcast, and the like by country, and a transmission aspect of the infrastructure information or the traffic information may be different by country. A lot of cost is needed to make the vehicle actually travel by country in order to test the operation in a case where the data elements are input. Since the prototype is not mass-produced, a lot of time and cost are needed to send the prototype to each country and to test the prototype.

In the vehicle traveling simulation system 1 of the embodiment, even though the vehicle is not made to travel, the operation of the multimedia device 10 in a case where the vehicle is actually made to travel is simulated, and the test is executed. The input data creation devices 14 enable execution of a test at places apart from the position of the multimedia device 10, thereby inputting the infrastructure information or the traffic information of the countries to the multimedia device 10. The vehicle traveling simulation system 1 shares and uses the infrastructure information and the traffic information acquired by the input data creation devices 14 for a simulation, thereby simulating states in which vehicles travel on roads in other countries.

Figure 3:
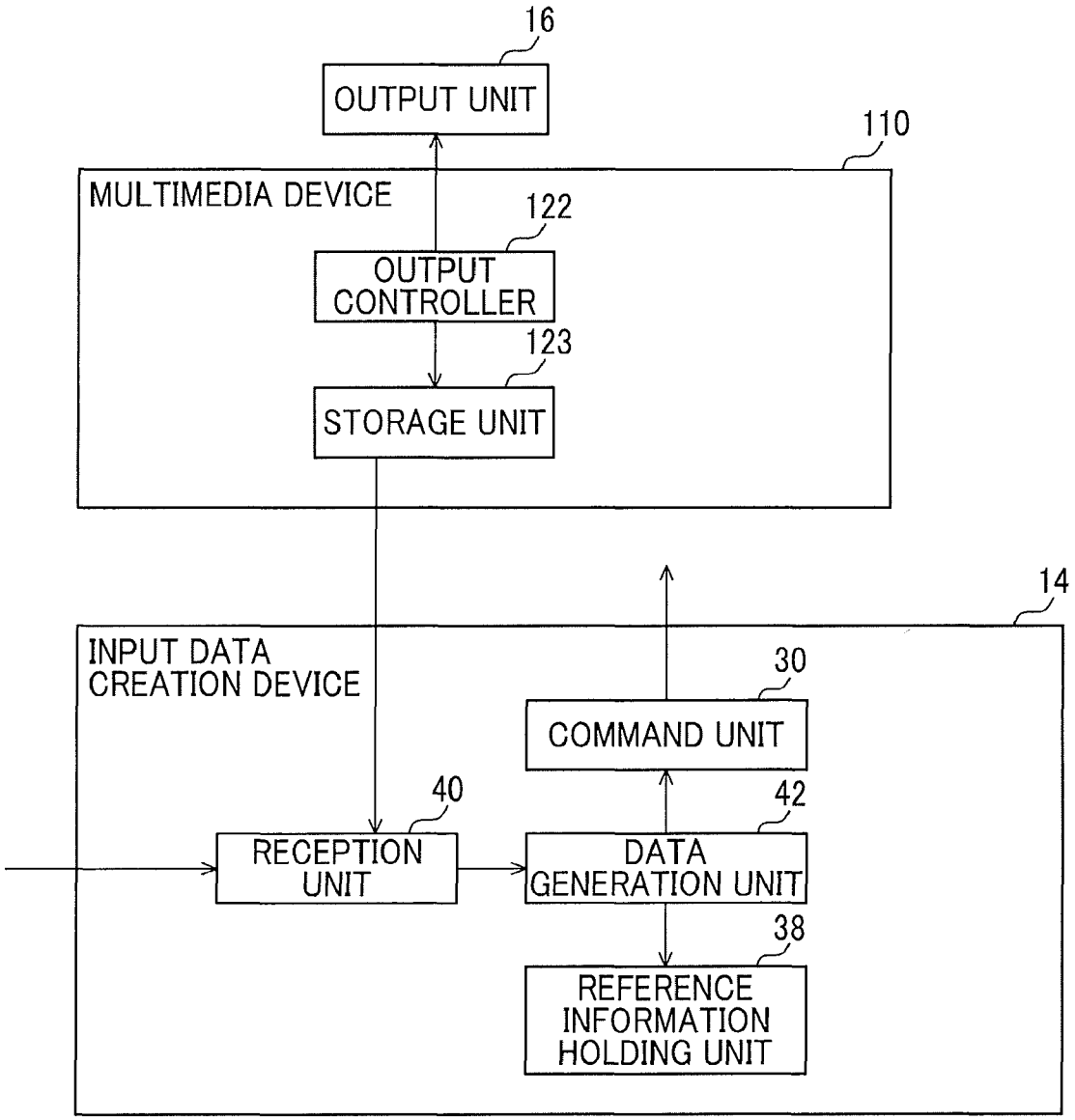
FIG. 3 is a diagram illustrating the configuration for creating input data for a simulation.
Figure 4:
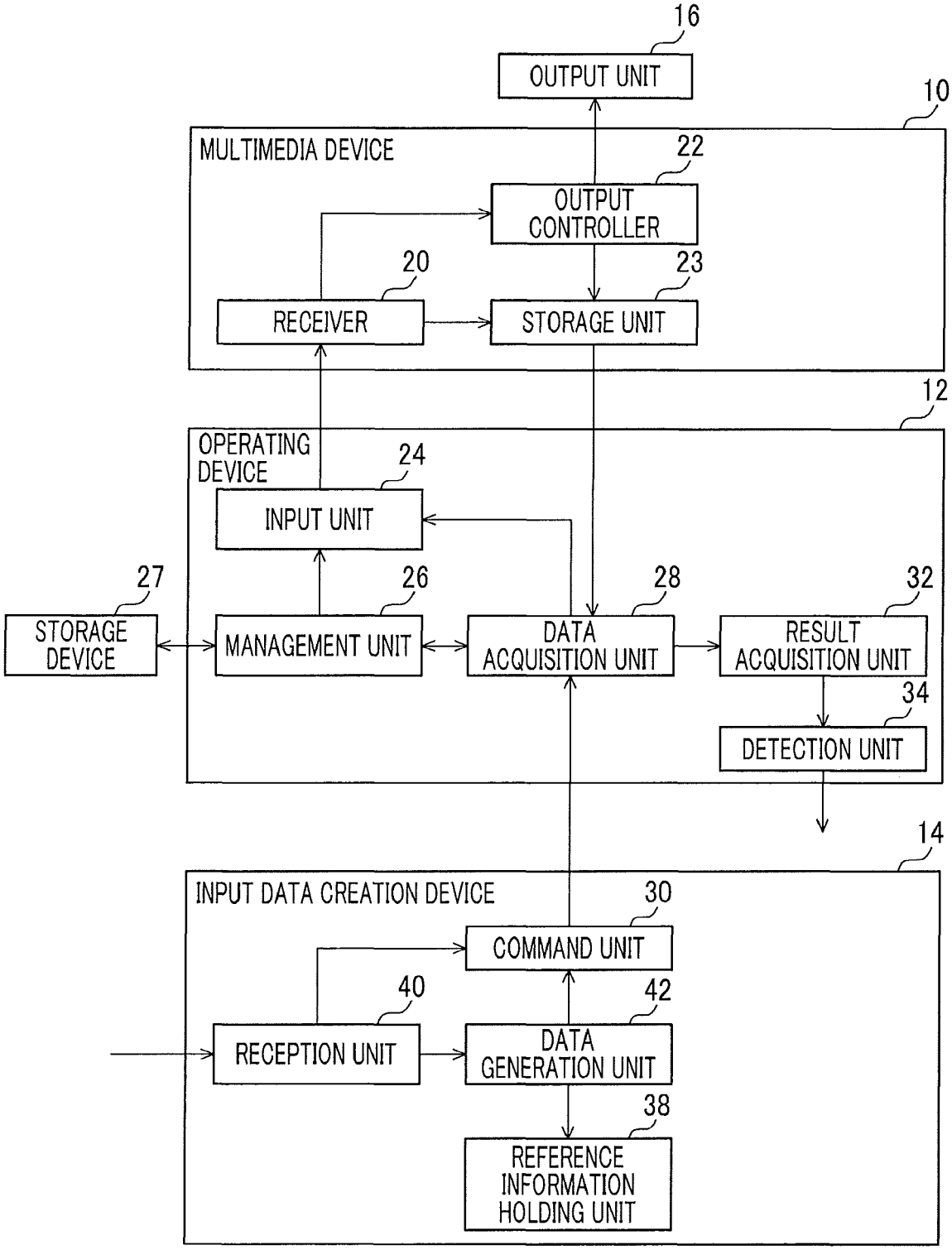
FIG. 4 is a diagram illustrating the functional configuration of the vehicle traveling simulation system.

FIG. 3 is a diagram illustrating the configuration for creating input data for a simulation. In FIG. 3 and FIG. 4 described below, elements that are described as functional blocks for executing various kinds of processing can be constituted of a circuit block, a memory, and other large scale integration circuits (LSIs) in terms of hardware or are implemented by a program or the like loaded in a memory in terms of software. Accordingly, it can be understood by those skilled in the art that the functional blocks can be implemented in various forms by hardware solely, software solely, or a combination of hardware and software, and are not limited to either one.

A multimedia device 110 shown in FIG. 3 is not a prototype, and is mounted in an actual vehicle. The multimedia device 110 has an output controller 122 and a storage unit 123.

The output controller 122 performs control such that an output unit 16 simultaneously executes various media functions according to the data elements input during vehicle traveling. The storage unit 123 stores the data elements input to the output controller 122 and an output result, such as an image or sound, output from the output unit 16 in association with a time.

The storage unit 123 stores vehicle status data input to the output controller 122 as diagnostic information using a diagnostic function of storing the vehicle status. The diagnostic information obtained by storing data transmitted and received through controller area network (CAN) communication or the like during vehicle traveling is not limited to the vehicle status data, and also includes operation information of the multimedia device 110 operated by the occupant, navigation information, and the like. The storage unit 123 stores data input to the multimedia device 110 and data output from the multimedia device 110 in a time series.

The vehicle mounted with the multimedia device 110 travels on an actual road and stores data for use in creating input data of the input data creation device 14 in the storage unit 123.

The input data creation device 14 has a command unit 30, a reference information holding unit 38, a reception unit 40, and a data generation unit 42. In FIG. 3, a function of creating the input data of the input data creation device 14 is described. A function of testing the multimedia device 10 based on the input data will be described in FIG. 4 described below.

The reception unit 40 acquires the diagnostic information of the vehicle and the traffic information and the infrastructure information output from the external device as data for generating the input data for a simulation. The diagnostic information of the vehicle includes the vehicle status data, such as GPS information, vehicle speed information, and acceleration information.

The diagnostic information is acquired in a case where the vehicle mounted with the multimedia device 110 travels on a predetermined road. The diagnostic information is traveling data indicating the vehicle status along a time axis and is acquired from the storage unit 123. The traffic information and the infrastructure information may be input from an external storage medium, and may be data along the same time axis stored in another storage medium during vehicle traveling for storing the diagnostic information.

The data generation unit 42 extracts the vehicle status data from the diagnostic information to generate the input data for operating the multimedia device 10 for a vehicle. The data generation unit 42 can set a generation timing of the traffic information generated on the time axis of the input data. That is, the data generation unit 42 can process the traffic information so as to be generated at a predetermined timing.

The traffic information is often notified by an interrupt during execution of the media function. In a case where an interrupt frequency and an interrupt amount of the traffic information increase, a load of the multimedia device 10 increases, and a state in which an error of the multimedia device 10 readily occurs can be brought. Although actual traveling data before processing can be input to the multimedia device 10 as it is, since normal traveling is performed, the actual traveling data may not include an input for reproducing a high load, an abnormal value, or the like, and a test regarding whether or not an error notification is normally output is hardly executed.

Accordingly, the data generation unit 42 sets the generation timing of the traffic information generated on the time axis of the input data and shifts the generation timing of the traffic information already included or adds the traffic information to the input data at any timing, thereby generating input data for implementing a desired test. The traffic information may be data acquired while the vehicle mounted with the multimedia device 110 is traveling or may be data generated in a pseudo manner.

The data generation unit 42 interrupts the traffic information into the input data according to a load mode set by a user. For example, the user sets the load mode of the input data before generation of the input data to any one of a low load, a middle load, and a high load, and the data generation unit 42 receives the load mode set by the user from the reception unit 40 and generates the input data with an interrupt frequency and an interrupt amount of the traffic information according to the set load mode. For example, in a case where a plurality of pieces of traffic information is generated within a short interval, the multimedia device 10 can be brought into a high load state. With this, it is possible to automatically include the traffic information with the interrupt frequency and the interrupt amount according to the set load mode in the input data, and to save effort for creating the input data. Furthermore, it is possible to test the operation of the multimedia device 10 according to a load state. The data generation unit 42 may process and form at least one of the frequency and the data amount of the traffic information. The user may set a load mode at a designated time on the time axis of the input data, and the data generation unit 42 may interrupt the traffic information according to the load mode in the designated time.

In order to advance the load mode, the data generation unit 42 may interrupt the traffic information at a timing at which the load state of the multimedia device 110 is high in the input data. For example, the data generation unit 42 interrupts the traffic information in a state in which a large number of media functions are simultaneously executed on the time axis of the input data, thereby implementing the high load state. Among the media functions, a function of executing image recognition processing or voice recognition processing is a function having a high load. The data generation unit 42 holds information of a function having a high processing load in advance and may interrupt the traffic information during execution of the function having a high processing load.

The data generation unit 42 can not only process the traffic information at the time of generation of the input data, but also change the values of the data elements. For example, the data generation unit 42 changes the value of the vehicle status data, such as a vehicle speed or an acceleration, so as to indicate an abnormal state, and a test is executed regarding whether or not the multimedia device 10 can execute appropriate error processing. For example, the data generation unit 42 can set the value of the vehicle speed included in the input data large, and a test can be executed regarding whether or not the multimedia device 10 outputs a warning "please reduce speed" with respect to the vehicle speed.

The data generation unit 42 extracts any one of the data elements included in the diagnostic information to generate the input data. That is, the data generation unit 42 can sort out the data elements, such as the vehicle speed information, the acceleration information, angular velocity information, the GPS information, and the operation information of the multimedia device 10, included in the diagnostic information to extract solely a desired data element. With this, it is possible to generate the input data solely with the kind of the data element needed for a test, and to increase the degree of freedom of a test.

The data generation unit 42 acquires a series of display images of a display during actual vehicle traveling, and generates data for evaluation for evaluating whether or not a defect occurs in the output of the multimedia device 10 at the time of a simulation. The data generation unit 42 receives the actual traveling data from the reception unit 40 and the output of the multimedia device in a case where the traveling data is acquired, processes the actual traveling data to input data, and processes the output of the multimedia device to data for evaluation. The data for evaluation includes display images and sound signals in a time-series order. For example, in a case where the generation timing of the traffic information included in the traveling data is interrupted, the data generation unit 42 changes a display image such that notification based on the traffic information is displayed on the display. In a case where the input data of the in-vehicle sensor is set to an abnormal size, the data generation unit 42 generates data for evaluation such that a predetermined warning is output at the timing. The reference information holding unit 38 holds the data for evaluation generated by the data generation unit 42.

In this way, the input data creation device 14 creates the input data, and creates the data for evaluation for evaluating the output result of the multimedia device 10 operated with the input data. Next, an aspect in which the input data creation device 14 executes a test with the input data will be described.

FIG. 4 is a diagram illustrating the functional configuration of the vehicle traveling simulation system 1. The multimedia device 10 shown in FIG. 4 is different from the multimedia device 110 actually mounted in the vehicle in FIG. 3, and is prototype. The multimedia device 10 has a receiver 20, an output controller 22, and a storage unit 23. The operating device 12 has an input unit 24, a management unit 26, a data acquisition unit 28, a result acquisition unit 32, and a detection unit 34.

The receiver 20 of the multimedia device 10 receives operation data corresponding to the input data for a simulation including the vehicle status data for reproducing traveling on an actual road from the operating device 12. The operation data corresponds to the input data, and is converted to a signal usable in the multimedia device 10. The operation data may be the same as the input data depending on the data element.

The output controller 22 performs control such that the output unit 16 simultaneously executes various media functions based on the input data for a simulation. For example, the output controller 22 receives the GPS information to make the display of the output unit 16 display an image indicating the position of the host vehicle, receives a captured image to make the display display a vehicle surrounding environment, receives radio information to output radio sound from the speaker, receives the traffic information, such as congestion information, by a beacon to make the display give notification of the traffic information, or receives information of a clearance sonar or a vehicle speed sensor to output a warning for giving notification of a collision possibility of an obstacle. The output controller 22 can turn on or off each media function for each simulation according to a command of the input data creation device 14.

The output controller 22 turns off an input from an actual input path, such as the in-vehicle sensor or a GPS function, in a case where the input data for a simulation is input to the receiver 20. The in-vehicle sensor, such as the vehicle speed sensor or an acceleration sensor, is attached to the multimedia device 10, and in a case where an input from the actual input path is not turned off, there is a concern that the input data for a simulation is overwritten. The output controller 22 turns off an input from the actual input path, such as the in-vehicle sensor or the GPS function, at the time of a simulation, thereby restraining data for a simulation and an actual sensor value from being input to the multimedia device 10 double.

The storage unit 23 stores the operation data input to the receiver 20 and an output result, such as an image or sound, output from the output unit 16 in association with a time. That is, the storage unit 23 stores the input data for use in an input to the multimedia device 10 and output data from the multimedia device 10 in a time series. The storage unit 23 may store the input data and the output data as diagnostic information using the diagnostic function of storing the vehicle status. The storage unit 23 may also store the infrastructure information and the traffic information as diagnostic information. Information stored in the storage unit 23 is transmitted to the input data creation device 14 through the operating device 12 for evaluation of the functions of the multimedia device 10.

The data acquisition unit 28 of the operating device 12 acquires the input data for a simulation input to the multimedia device 10 from the command unit 30 of the input data creation device 14. The data acquisition unit 28 acquires the input data for a simulation for simulating the vehicle status during vehicle traveling from any one of the input data creation devices 14 for each simulation.

The data acquisition unit 28 acquires the output data of the multimedia device 10 from the storage unit 23 of the multimedia device 10 and transmits the output data to the result acquisition unit 32.

The management unit 26 stores the input data for a simulation for use in the input to the multimedia device 10 in a storage device 27, and enables reuse of any one of the data elements included in the input data according to a request from the input data creation device 14. For example, the management unit 26 can extract the infrastructure information of other countries used in past simulations, and the input data creation devices 14 can share and use the input data stored in the storage device 27. The storage device 27 may be a provided in a laboratory on the operating device 12 side or may be provided in an external server as cloud data.

The input unit 24 converts the input data for a simulation to operation data transmitted and received based on a standard of a universal serial bus (USB) or Ethernet (Registered Trademark) and inputs the operation data to the multimedia device 10 according to a time axis set in the input data. The operation data is a signal that is obtained by converting the input data in a form usable in the multimedia device 10. With this, since positional information or traffic information during vehicle traveling is input, the multimedia device 10 shows a behavior in a vehicle traveling state, and the position of the vehicle or the traffic information is displayed on the display of the multimedia device 10.

The input unit 24 can set the presence or absence of operation of each of the media functions executable in the multimedia device 10 according to a command from the command unit 30 of the input data creation device 14 for each test. That is, the multimedia device 10 can be operated while a function to be a test target among the media functions is set on and a function to be not a test target is set off. For example, in a case where analog broadcast, digital broadcast, and satellite broadcast are executable in the multimedia device 10 as the radio function, the input unit 24 can turn off the radio function of analog broadcast and satellite broadcast to be not a test target and can turn on digital broadcast to be a test target. With this, the on and off of the function to be a test target is set, whereby it is possible to exclude a function not used in any country from the function to be a test target.

The input unit 24 may add past input data stored in the storage device 27 to the input data according to a command from the command unit 30 of the input data creation device 14. For example, the input unit 24 may transmit the radio information as one of the items included in the past input data stored in the storage device 27 to the receiver 20 in addition to the input data acquired from the command unit 30.

The reception unit 40 of the input data creation device 14 acquires the data elements for a vehicle, such as the diagnostic information of the vehicle and the traffic information output from the external device. The reception unit 40 receives information relating to generation of the input data for a simulation according to an input from the user. The reception unit 40 receives information indicating the on and off of the media function at the time of a test. With this, it is possible to set the presence or absence of operation of the media functions executable in the multimedia device 10 for each simulation, and to set a media function to be a target of a simulation. The reception unit 40 transmits the received input of the user to the command unit 30 and the data generation unit 42.

The data generation unit 42 may receive data elements used in other simulations through the management unit 26 of the operating device 12 and may use the data elements for processing. For example, the data generation unit 42 may acquire radio data for satellite digital broadcast broadcasted in other countries in the past and may add the radio data to the input data. In this way, the input data creation devices 14 can share the input data used in the past.

The command unit 30 transmits the generated input data for a simulation to the data acquisition unit 28 of the operating device 12 and gives an instruction to operate the multimedia device 10 with the input data. The command unit 30 transmits information for giving an instruction of the on and off of a media function to the data acquisition unit 28 in addition to the input data. With this, it is possible to set the presence or absence of operation of the media functions executable in the multimedia device 10 for each simulation.

The result acquisition unit 32 acquires the output data stored as the diagnostic information in the storage unit 23 of the multimedia device 10. That is, the result acquisition unit 32 acquires an output result of the multimedia device 10 in a case where a simulation is executed. The output data includes a series of images displayed on the display of the output unit 16, voice output from the speaker of the output unit 16, and the like. With this, it is possible to detect a defect on the input data creation device 14 side.

The detection unit 34 compares an output result of the multimedia device 10 in a case where a simulation is executed with data for evaluation held in advance to detect a defect of the output result. The detection unit 34 determines whether or not a display image of the display included in the output data coincides with a display image included in the data for evaluation by a predetermined reference value or more, detects that a defect occurs in a case where the display images do not coincide with each other, and detects that a defect does not occur in a case where the display images coincide with each other. A detection result of the detection unit 34 is displayed on the display or the like. For example, in a case where the traffic information is input from the beacon, the detection unit 34 determines whether or not interrupt notification is normally displayed on the display. With this, it is possible to automatically detect a defect.

The embodiment is just illustrative, and it can be understood by those skilled in the art that various modification examples to a combination of the components may be made and such modification examples also fall within the scope of the disclosure.

In the embodiment, although an aspect in which the storage unit 123 stores the vehicle status data has been described, the disclosure is not limited to the aspect, and the storage unit 123 may store the traffic information and the infrastructure information in a time series in addition to the vehicle status data. That is, there are a case where the data elements stored in the storage unit 123 and the vehicle status data are included, and a case where the vehicle status data, the traffic information, and the infrastructure information are included. In any cases, the data generation unit 42 can shift the generation timing of the traffic information or may add the traffic information.

In the embodiment, although an aspect in which the result acquisition unit 32 and the detection unit 34 are provided in the operating device 12 has been described, the disclosure is not limited to the aspect, the result acquisition unit 32 and the detection unit 34 may be provided in the input data creation device 14.

What is claimed is:

1. An input data creation device comprising:

a reception unit configured to acquire diagnostic information of a vehicle and traffic information output from an external device; and a data generation unit configured to extract a plurality of data elements indicating a vehicle status during vehicle traveling from the diagnostic information to generate input data for operating a multimedia device of the vehicle based on the extracted data elements, wherein the data generation unit is further configured to set a timing at which the traffic information is generated on a time axis of the input data, and change values of the data elements included in the input data.

2. The input data creation device according to claim 1, wherein the data generation unit is further configured to interrupt the traffic information into the input data according to a load mode set by a user.

3. The input data creation device according to claim 1, wherein the data generation unit is further configured to extract any data element among the data elements included in the diagnostic information to generate the input data.

4. An input data creation method comprising:

a step of acquiring diagnostic information of a vehicle and traffic information output from an external device; and a step of extracting a plurality of data elements indicating a vehicle status during vehicle traveling from the diagnostic information to generate input data for operating a multimedia device of the vehicle based on the extracted data elements, wherein a timing at which the traffic information is generated on a time axis of the input data is set, and values of data elements included in the input data are changed.

* * * * *